US012662821B1

(12) United States Patent
Benavides et al.

(10) Patent No.: US 12,662,821 B1
(45) Date of Patent: Jun. 23, 2026

(54) DOOR AND RETRACTABLE LADDER ASSEMBLY

(71) Applicant: Louisville Ladder Inc., Louisville, KY (US)

(72) Inventors: Silvia Janeth Guzman Benavides, Monterrey (MX); Cecilia Judith Puentes Sanchez, Monterrey (MX); Carlos Andres Rodriguez Garza, Monterrey (MX)

( * ) Notice: Subject to any disclaimer, the term of this patent is extended or adjusted under 35 U.S.C. 154(b) by 1059 days.

(21) Appl. No.: 17/553,362

(22) Filed: Dec. 16, 2021

(51) Int. Cl.
*E04F 11/06* (2006.01)

(52) U.S. Cl.
CPC ..... *E04F 11/064* (2013.01)

(58) Field of Classification Search
CPC ..... E04F 11/064; E04F 11/062; E04F 11/06; E04F 11/04; E04F 11/16; E04B 9/003
USPC ..... 182/70, 77–80
See application file for complete search history.

(56) References Cited

U.S. PATENT DOCUMENTS 2,945,548 A * 7/1960 Tapp ..... E04F 11/064 182/77
3,782,054 A * 1/1974 Goss, Jr. ..... E06B 3/9682 403/295
3,807,528 A 4/1974 Frank
3,866,380 A * 2/1975 Benson ..... E06B 3/667 403/231
3,901,353 A * 8/1975 Skolnik ..... E04F 11/064 182/78
4,541,508 A * 9/1985 Lundh ..... E04F 11/064 182/78
4,563,845 A * 1/1986 Stipe ..... E06B 5/01 52/202
5,050,706 A * 9/1991 Cole ..... E04F 11/064 182/78
5,239,795 A 8/1993 Breaux
D344,594 S 2/1994 Whitney
5,339,920 A 8/1994 Eriksson
(Continued)

OTHER PUBLICATIONS stairwayshop.com, "American Stairways Husky 800 Aluminum Folding Attic Ladder" (downloaded Sep. 13, 2021). https://www.stairwayshop.com/american-stairways-husky-800-aluminum-folding-attic-ladders-350-lbs-capacity.html.
(Continued)

*Primary Examiner* — Christopher Garft
(74) *Attorney, Agent, or Firm* — Stites & Harbison, PLLC; Terry L. Wright

(57) ABSTRACT

A door and retractable ladder assembly for providing access to and from an upper story of a building includes a frame that is configured to be mounted within an opening defined by a ceiling structure, a retractable ladder assembly, and a door. To facilitate improved sealing of the opening, the frame preferably includes a recess that is coextensive with and is configured to receive the perimeter of the door and an outer cavity that is configured to receive a weatherstripping material. The frame includes a plurality of frame members. The frame members can be cut at predetermined angles so that the frame includes a plurality of miter joints through which connectors configured to connect adjacently positioned frame members can extend. A section of the retractable ladder can be mounted directly to an inner surface of the door to eliminate the need for intermediate connection means.

11 Claims, 10 Drawing Sheets

(56) References Cited

U.S. PATENT DOCUMENTS

| | | | | |
|---|---|---|---|---|
| 5,931,258 | A * | 8/1999 | Lorentz | E06C 7/182 182/106 |
| 6,994,184 | B2 | 2/2006 | Latimer et al. | |
| 7,150,130 | B2 * | 12/2006 | Kobayashi | E06B 3/26301 52/210 |
| 7,165,649 | B2 | 1/2007 | Latimer et al. | |
| 7,596,912 | B2 | 10/2009 | Ito et al. | |
| 8,028,804 | B2 | 10/2011 | Lair | |
| 8,272,477 | B1 * | 9/2012 | Hudspeth | E04B 9/003 182/78 |
| 8,286,752 | B2 | 10/2012 | McIntire et al. | |
| 8,857,129 | B2 * | 10/2014 | Beranek | E06B 3/9682 52/204.5 |
| 8,997,411 | B2 | 4/2015 | Whitten et al. | |
| 9,447,637 | B2 | 9/2016 | Morrow et al. | |
| 9,540,824 | B1 | 1/2017 | Sandburg | |
| 9,695,630 | B1 * | 7/2017 | Arthur | E04B 1/76 |
| 10,066,397 | B1 | 9/2018 | Sandburg | |
| 10,294,077 | B2 | 5/2019 | MacDonald et al. | |
| 10,538,966 | B2 | 1/2020 | Woodward et al. | |
| 2013/0111847 | A1 * | 5/2013 | Emanuel | E06B 3/22 52/656.9 |
| 2013/0256057 | A1 * | 10/2013 | Kasinski | E04F 11/064 182/81 |

OTHER PUBLICATIONS

SP Partners LLC, "Rainbow Attic Stair Installation Guide F-Series," Nov. 2016. https://www.industrialproducts.com/fileuploader/download/download/?d=0&file=custom/upload/Installation+-+Rainbow+F-Series+Attic+Ladders.pdf.

* cited by examiner

DOOR AND RETRACTABLE LADDER ASSEMBLY

TECHNICAL FIELD

The present invention is a door and retractable ladder assembly for providing access to and from an upper story of a building, such as an attic or loft. In particular, the present invention relates to a door and retractable ladder assembly that makes use of a frame with features that facilitate improved sealing of an opening in which the door and retractable ladder assembly is mounted.

BACKGROUND

Door and retractable ladder assemblies, often referred to as "attic ladders," are commonly utilized to provide a means of access between a lower story of a building and an upper story of a building, such as an attic or loft. In use, the door and retractable ladder assembly is mounted within an opening defined by a ceiling and can be selectively transitioned between an open configuration, where a door of the assembly is in an open position and a ladder is deployed to provide access to or from the upper story of the building, and a closed configuration, where the door is closed and the ladder is retracted to store the assembly within the ceiling.

In door and retractable ladder assemblies of known construction, the door is, however, typically positioned below and merely abuts a bottom edge of a frame of the assembly when the door is closed and the assembly is in the closed configuration. As a result, gaps or cracks through which light or other environmental conditions (e.g., cold air) can escape from the upper story of the building to the lower story of the building, or vice versa, are common. Gaps or cracks through which light or other environmental conditions can escape can also result from the frame of the assembly not being properly fitted to the opening in which it is mounted. It is thus important that the dimensions of the frame of the assembly, and, in particular, the corners thereof, correspond to that of the opening in which it is mounted. The presence of gaps or cracks due to the foregoing deficiencies not only results in a less aesthetically pleasing finish, but can also adversely affect conditions within the upper or lower story of the building (e.g., heating or cooling a portion of the building in an undesired manner). Some door and retractable ladder assemblies of known construction are designed to accommodate weatherstripping, which can help mitigate the extent to which undesired environmental conditions permeate from one story of the building to another. However, these assemblies generally require that the frame of the assembly be specially modified after its initial formation or construction, thereby increasing the overall number of processes required during manufacture and the potential cost imposed on the end user.

Accordingly, door and retractable ladder assemblies that provide improved sealing of the opening in which the assembly is mounted and which reduce the overall number of manufacture processes needed to accommodate weatherstripping would be both highly desirable and beneficial.

SUMMARY

The present invention is a door and retractable ladder assembly for providing access to and from an upper story of a building, such as an attic or loft. In particular, the present invention relates to a door and retractable ladder assembly that makes use of a frame with features that facilitate improved sealing of an opening in which the door and retractable ladder assembly is mounted.

An exemplary door and retractable ladder assembly includes: a frame that is configured to be mounted within an opening defined by a ceiling structure of a building; a retractable ladder which includes a plurality of ladder sections; and a door mounted to the frame and one of the plurality of ladder sections. The frame defines a central opening for providing passage through the frame, and the door is mounted to the frame such that the door can be transitioned between a closed position to cover the central opening defined by the frame and an open position to uncover the central opening defined by the frame. In use, when the door is in the open position, the retractable ladder can be deployed to place the door and retractable ladder assembly in an open configuration and provide a ladder upon which an individual can climb to access an upper story of the building. When access to the upper story of the building is no longer needed, the ladder can be retracted and the door transitioned to the closed position to place the door and retractable ladder assembly in a closed configuration to seal the opening in which the door and retractable ladder assembly is mounted. The bottom wall of the frame preferably defines a recess that is coextensive with and is configured to receive the perimeter of the door when the door is in the closed position. The recess thus enables the door of the door and retractable ladder assembly of the present invention to be partially encased (or embedded) within the frame when the assembly is placed in the closed configuration, thus minimizing the presence of gaps or cracks through which light and other environmental conditions can escape through the central opening of the frame. In some embodiments, the height of the recess is equal to or greater than the height of the door so that the door is fully received within the frame when the door is placed in the closed position.

In some embodiments, the bottom wall of the frame at least partially defines an outer cavity that is configured to receive a weatherstripping material. The outer cavity can be oriented relative to the recess such that, when the door is in the closed position, any weatherstripping material within the outer cavity is sandwiched or otherwise positioned between the door and the frame to minimize the extent to which light and/or other environmental conditions can escape through the central opening of the frame.

The frame includes a plurality of frame members. Each frame member includes an inner cavity that is configured to receive one or more connectors of a plurality of connectors for connecting the frame members of the frame together. To facilitate mounting of the frame to a ceiling structure, in some embodiments, each frame member defines one or more openings configured to receive a fastener, where each opening of the one or more openings defined by each frame member is positioned opposite of the one or more openings defined by another frame member. To help minimize the presence of gaps between the frame and the ceiling structure to which it is mounted, in some embodiments, each end of each frame member of the plurality of frame members is cut at a predetermined angle that corresponds to another predetermined angle cut in the end of another frame member of the plurality of frame members, such that, when assembled, the frame includes a plurality of miter joints. In some embodiments, each miter joint of the plurality of miter joints defines an approximately 90° angle.

In some embodiments, when the frame is assembled, each connector of the plurality of connectors is housed within the inner cavity of two adjacently positioned frame members and extends through a miter joint within the frame. In some embodiments, the plurality of connectors includes a plurality of spring-loaded connectors, where each spring-loaded connector is configured to and interlocks with two adjacently positioned frame members. In some embodiments, each connector of the plurality of connectors is configured to receive a portion of two adjacently positioned frame members and the end of each frame member is crimped.

In some embodiments, a section of the retractable ladder is mounted directly to an inner surface of the door to eliminate the need for intermediate connection means, such as runners and/or brackets.

Further features and advantages of the present invention will become evident to those of ordinary skill in the art after a study of the description, figures, and non-limiting examples in this document.

DESCRIPTION OF EXEMPLARY EMBODIMENTS

The present invention is a door and retractable ladder assembly for providing access to and from an upper story of a building, such as an attic or loft. In particular, the present invention relates to a door and retractable ladder assembly that makes use of a frame with features that facilitate improved sealing of an opening of a ceiling structure in which the door and retractable ladder assembly is mounted.

Figure 1:
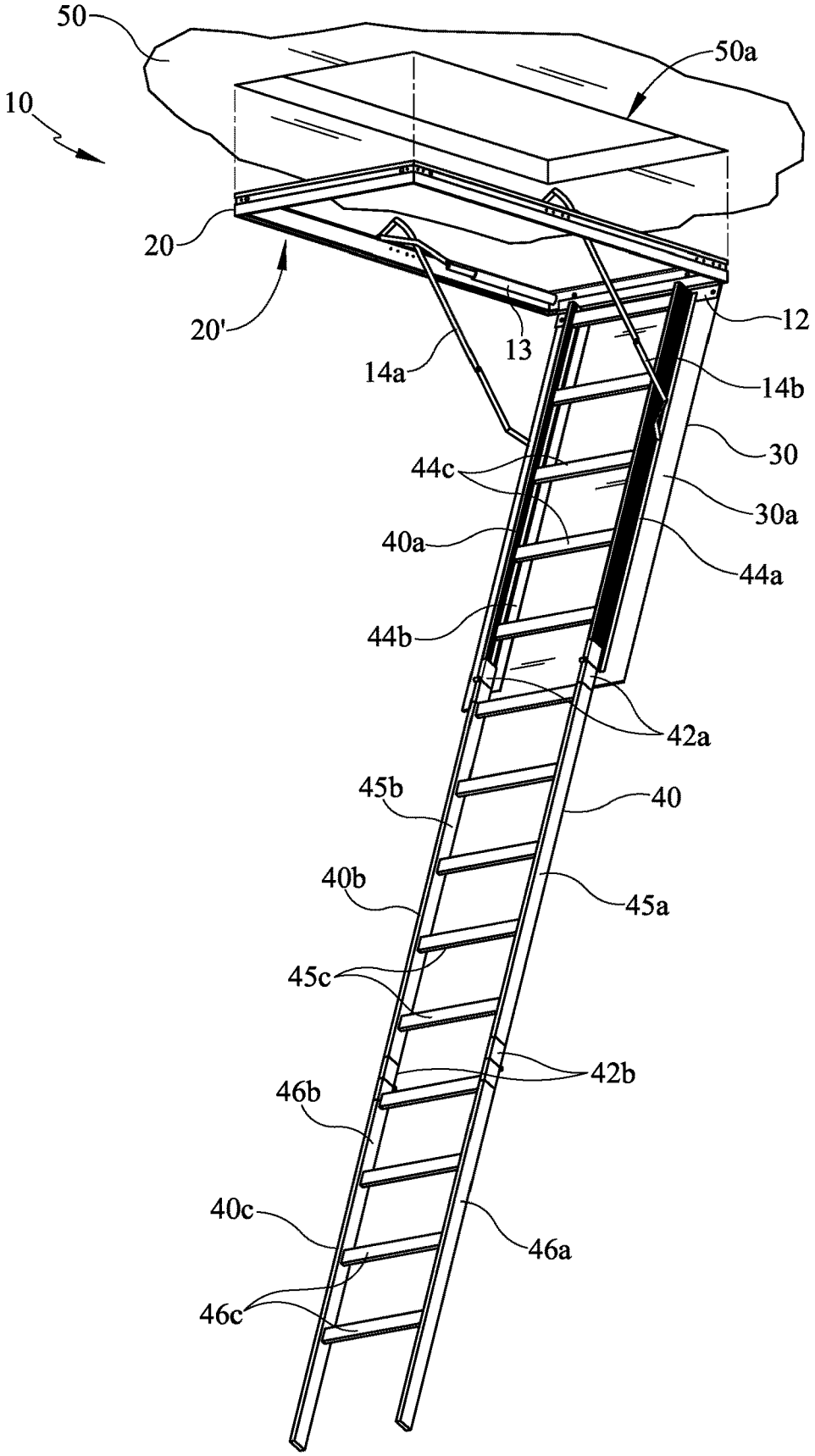
FIG. 1 is a perspective view of an exemplary door and retractable ladder assembly made in accordance with the present invention.
Figure 2:
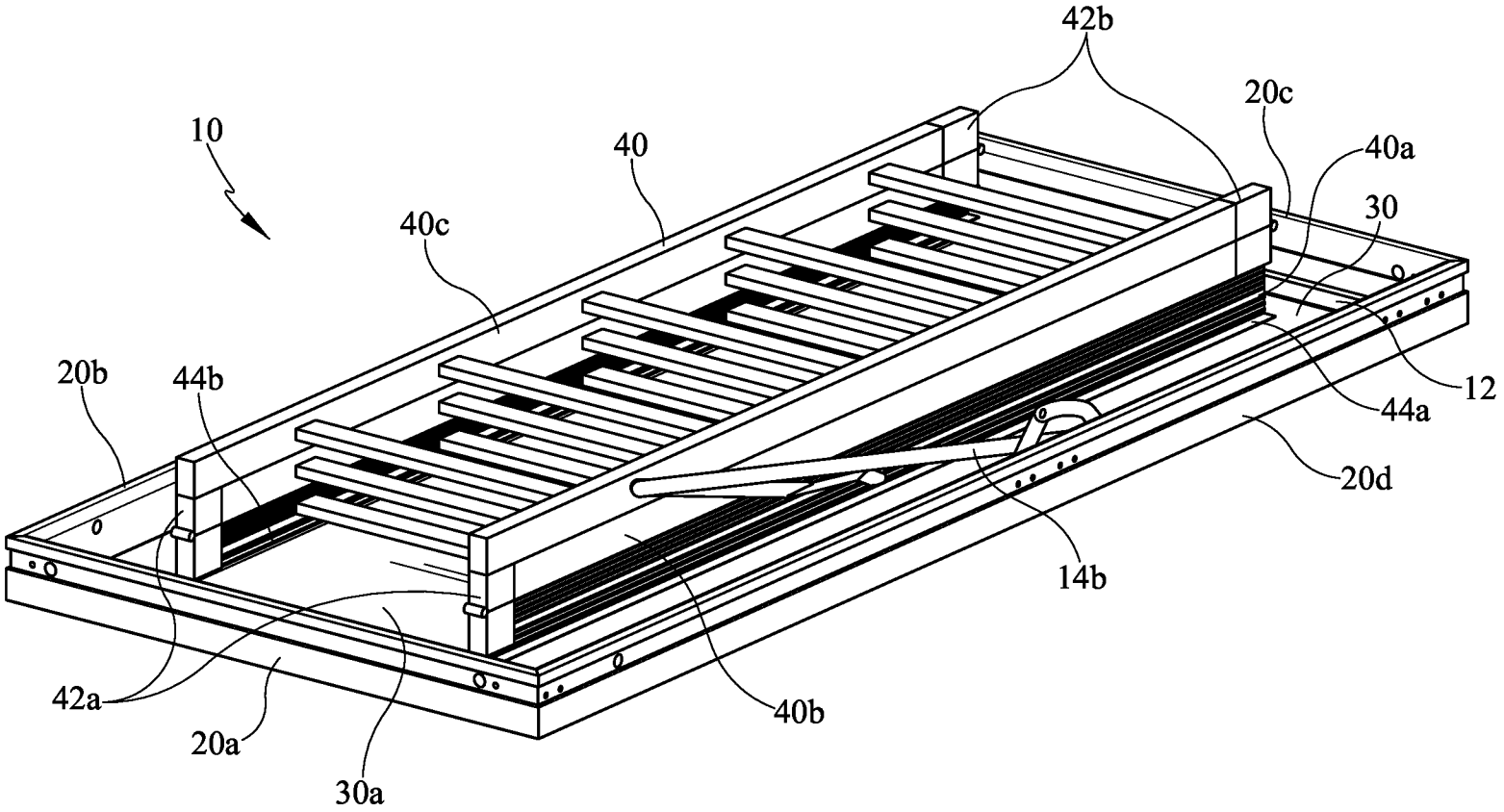
FIG. 2 is a perspective view of the exemplary door and retractable ladder assembly of FIG. 1, but in a closed configuration.

FIGS. 1 and 2 are perspective views of an exemplary door and retractable ladder assembly 10 (or assembly 10) made in accordance with the present invention in an open configuration and closed configuration, respectively. As shown, the assembly 10 includes: a frame 20; a door 30 mounted to the frame 20, such that the door 30 can be selectively transitioned between an open position (FIG. 1) and a closed position (FIG. 2); and a retractable ladder 40 mounted to the door 30. In use, the frame 20 is mounted within an opening 50*a* defined by a ceiling structure 50 (e.g., joists and/or headers) of a building to maintain the assembly 10 in association with the ceiling structure 50. Once the frame 20 is mounted to the ceiling structure 50 within the opening 50*a*, the assembly 10 can be selectively transitioned between the open configuration to provide a means of access to and from the upper story of the building and the closed configuration to neatly store the assembly 10 when access to the upper story of the building is not needed.

Referring still to FIGS. 1 and 2, the frame 20 defines, and thus can be characterized as including, a central opening 20' through which an individual can pass to travel through the frame 20 and thus the opening 50*a* defined by the ceiling structure 50 to enter or exit the upper story of the building. The door 30 is pivotally connected to the frame 20 in this exemplary embodiment by a hinge 12, such that the door 30 can be selectively transitioned between the closed position and the open position to cover and uncover, respectively, the central opening 20' of the frame 20. The retractable ladder 40 includes a plurality of individual ladder sections 40*a*, 40*b*, 40*c* of which at least one is mounted to an inner surface 30*a* of the door 30. In this regard, as the door 30 transitions between the open position and the closed position, the retractable ladder 40 is also moved. When the door 30 is in the open position, the retractable ladder 40 can be deployed to place the assembly 10 in the open configuration and provide a ladder upon which an individual can climb to access the upper story of the building. Specifically, in this exemplary embodiment, the retractable ladder 40 is a folding ladder where adjacent ladder sections of the plurality of ladder sections 40*a*, 40*b*, 40*c* are connected by pairs of hinges 42*a*, 42*b*, such that the retractable ladder 40 can be deployed (FIG. 1) and retracted (FIG. 2) by unfolding and folding the plurality of ladder sections 40*a*, 40*b*, 40*c*, respectively. Of course, other retractable ladder types may alternatively be utilized without departing from the spirit or scope of the present invention. For instance, in alternative embodiments, a telescoping ladder may be utilized.

Referring still to FIGS. 1 and 2, when access to the upper story of the building is no longer needed, the plurality of ladder sections 40*a*, 40*b*, 40*c* can be folded upon each other and the door 30 transitioned to the closed position to place the assembly 10 in the closed configuration and cover the central opening 20' of the frame 20, and, in turn, the opening 50*a* defined by the ceiling structure 50. To reduce the amount of force which must be exerted to direct the door 30 to, and maintain the door 30 in, the closed position, in this exemplary embodiment, the assembly 10 further includes a pair of toggle joints 14*a*, 14*b* and a pair of corresponding struts 13 (one of which is shown in FIG. 1), which, in this exemplary embodiment are gas-based struts of known construction.

FIGS. 3-6, 7A, and 7B are various views which show the frame 20 of the assembly 10, or certain components thereof.

Figure 3:
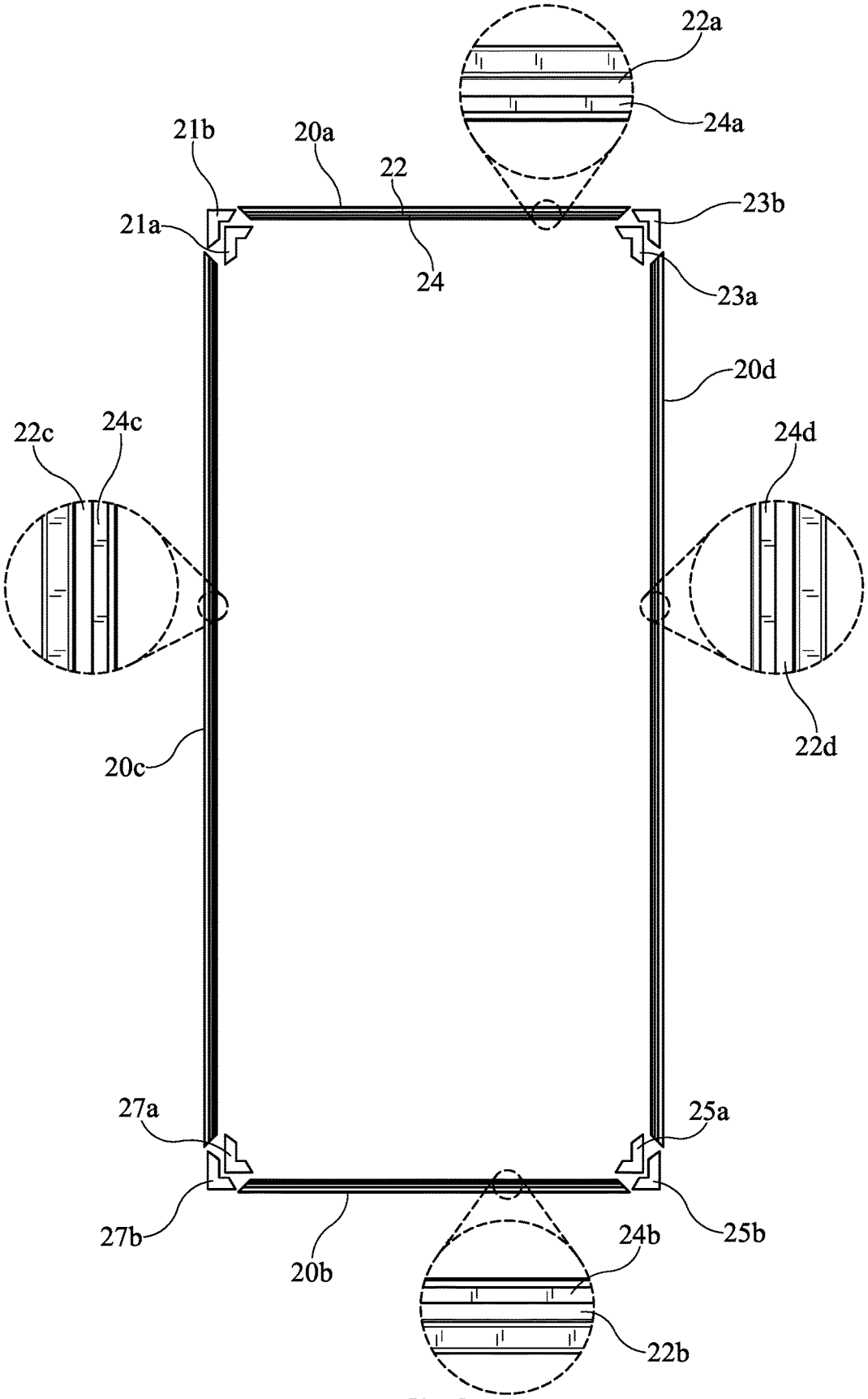
FIG. 3 is an exploded view of a frame and connectors of the exemplary door and retractable ladder assembly of FIG. 1.
Figure 4:
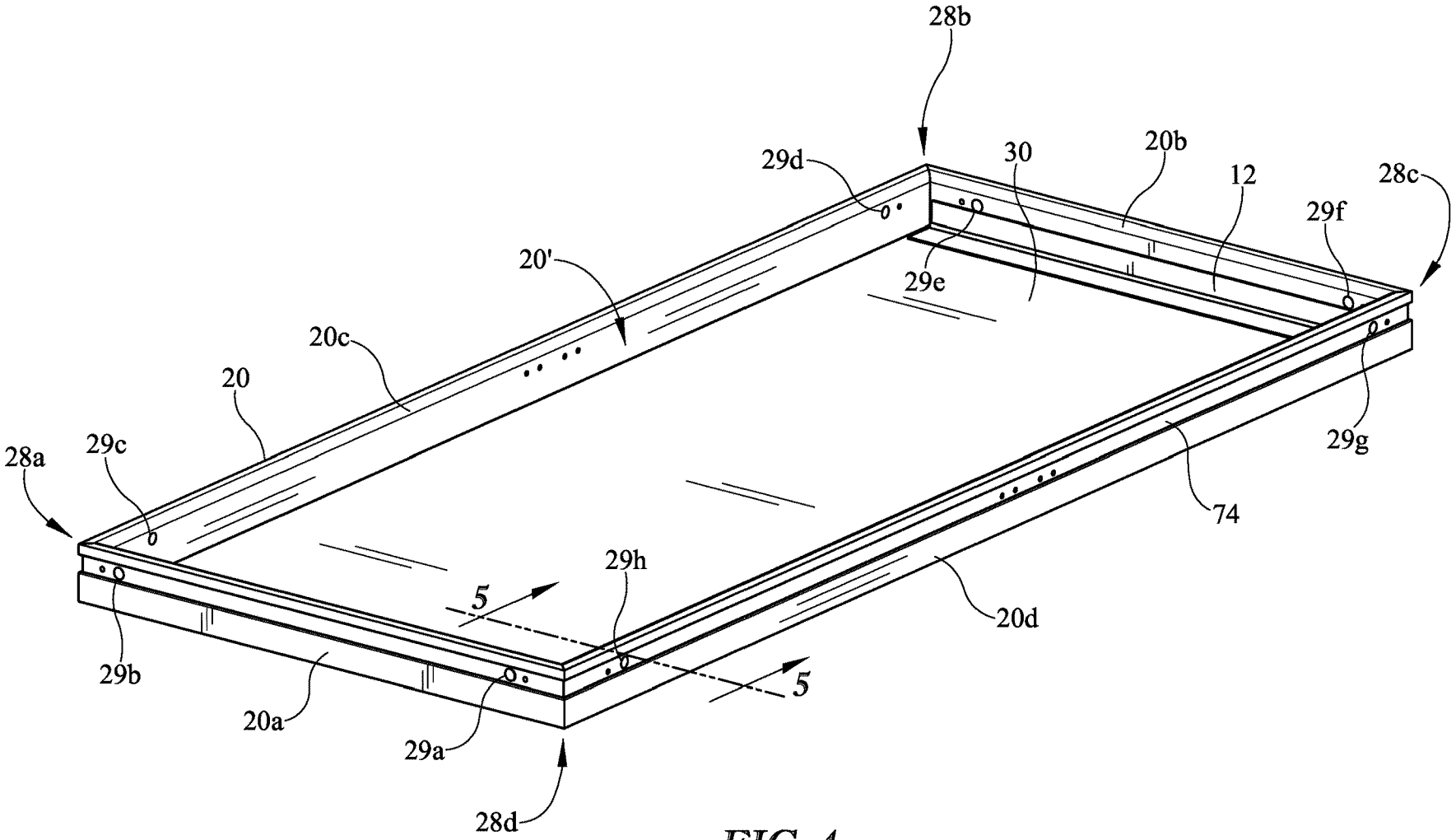
FIG. 4 is a perspective view of the frame and a door of the exemplary door and retractable ladder assembly of FIG. 1.
Figure 5:
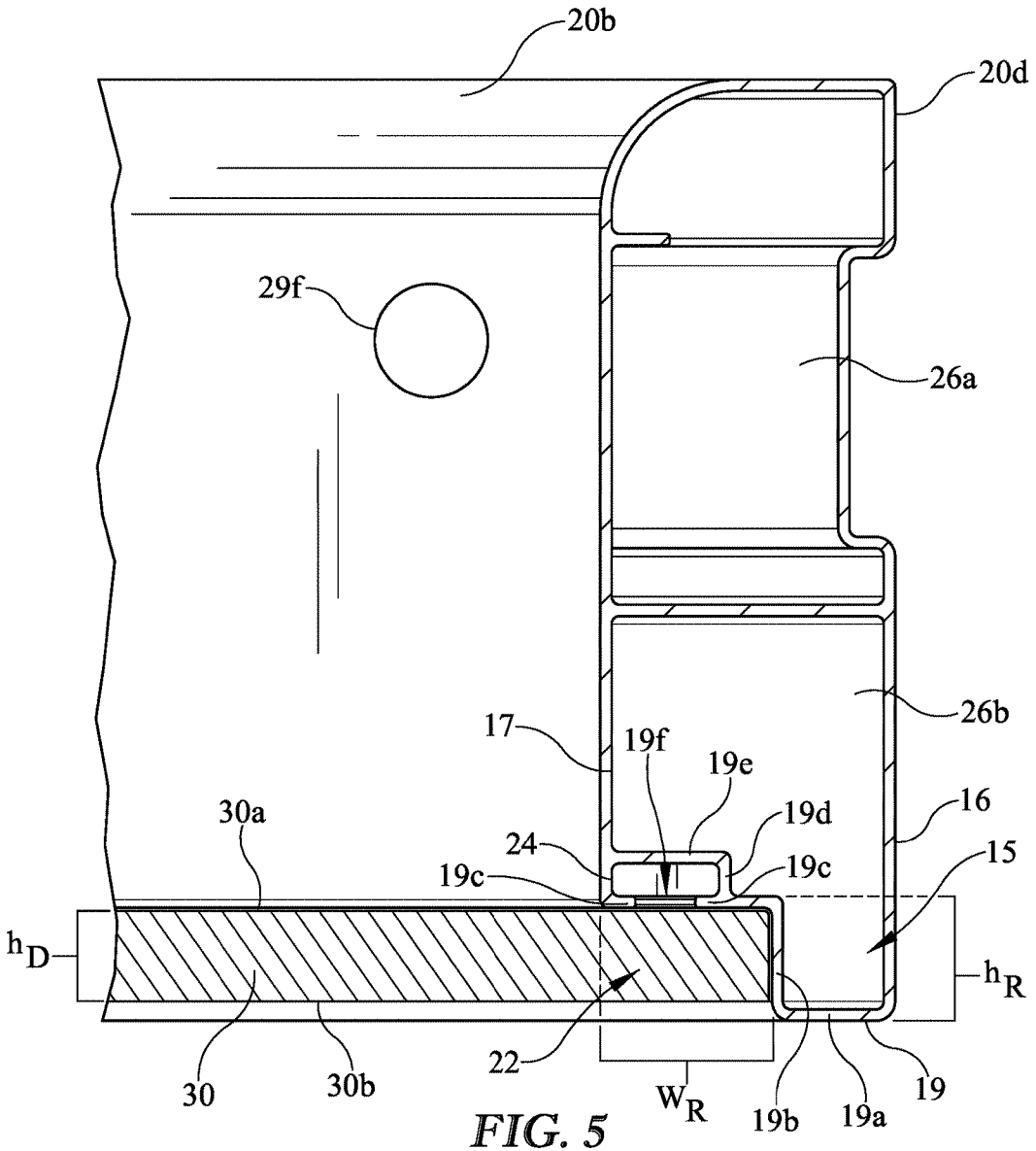
FIG. 5 is a partial sectional view of the frame and the door of the exemplary door and retractable ladder assembly of FIG. 1 taken along line 5-5 in FIG. 4.
Figure 6:
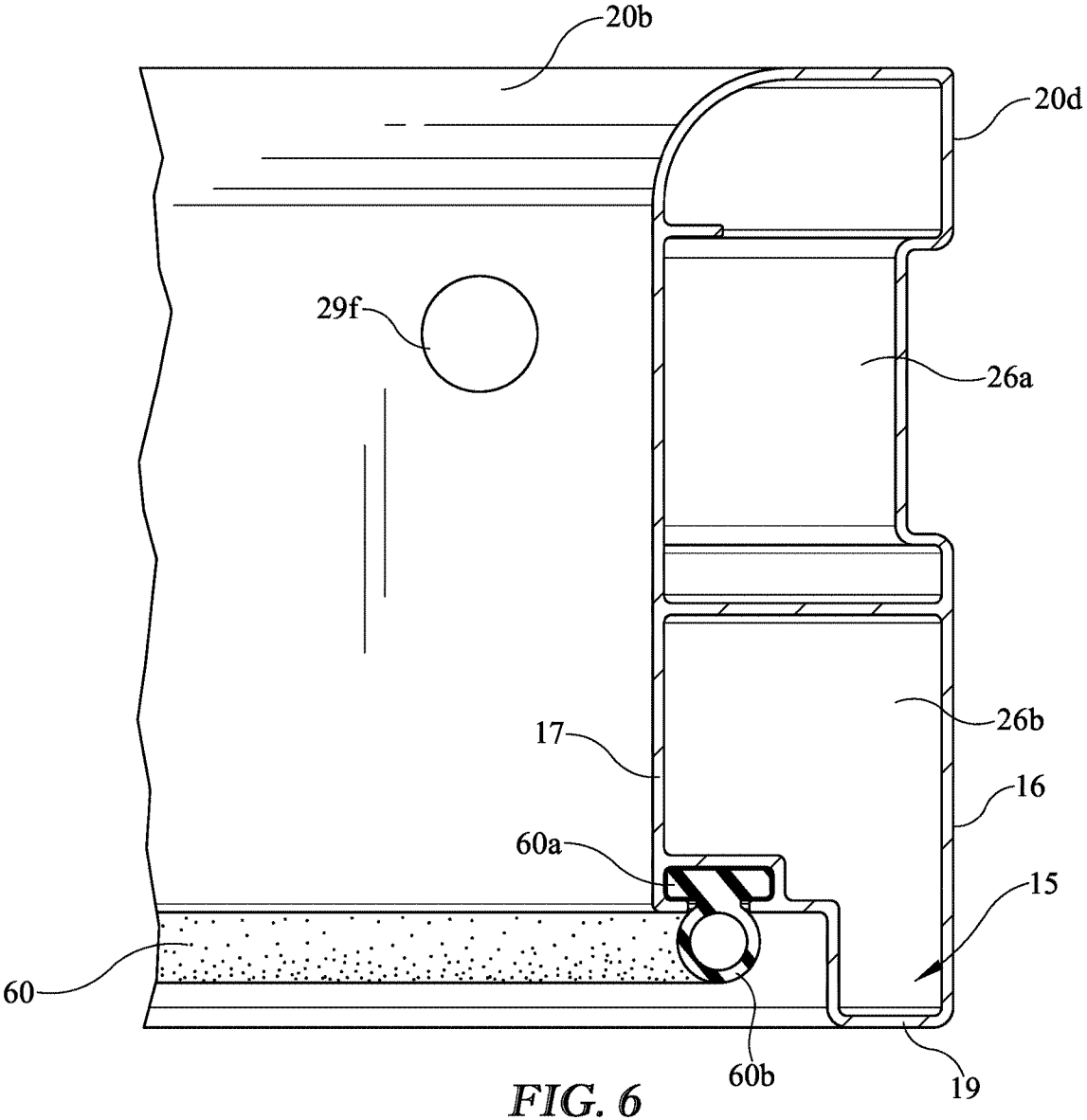
FIG. 6 is a partial sectional view similar to FIG. 5, but with the door removed and a weatherstripping material inserted into an outer cavity of the frame.

Referring now to FIGS. 2-6, 7A, and 7B, the bottom wall 19 of the frame 20 preferably defines a recess 22 that is coextensive with, and is configured to receive, the outer edges which define the perimeter of the door 30 when the assembly 10 is in the closed configuration, as further described below. Accordingly, unlike door and retractable ladder assemblies of known construction in which the door is positioned below and merely abuts the lowermost surface of a frame, the door 30 of the assembly 10 of the present invention is partially encased (or embedded) within the frame 20 when the assembly 10 is placed in the closed configuration, as best shown in FIG. 5. As a result of the foregoing construction, the assembly 10 of the present invention thus minimizes the presence of gaps or cracks between the frame 20 and the door 30 when the assembly 10 is in the closed configuration, and thus the extent to which light and/or other environmental conditions (e.g., cold air) can escape from the upper story of the building through the central opening 20' of the frame 20. In this exemplary embodiment, the bottom wall of the frame 20 also defines, at least partially, an outer cavity 24 in which a weatherstripping material 60 can be inserted and maintained, as shown in FIGS. 5-6. The outer cavity 24 is oriented relative to the recess 22 of the frame 20 such that, when the assembly 10 is in the closed configuration, any weatherstripping material 60 provided within the outer cavity 24 establishes a barrier which effectively fills any gaps or cracks existing between the frame 20 and the inner surface 30*a* of the door 30, thus further minimizing the extent to which light and/or other environmental conditions can escape from the upper story of the building through the central opening 20' of the frame 20. Further, in this exemplary embodiment, the frame 20 is also constructed so as to include a plurality of miter joints 28*a*, 28*b*, 28*c*, 28*d* with angles corresponding to that exhibited by the corners of the ceiling structure 50 to minimize the presence of, and limit the extent to which, light and/or other environmental conditions can escape through gaps between the frame 20 and the ceiling structure 50.

Referring now to FIGS. 1-5, the frame 20 is defined by, and thus can be characterized as including, a plurality of frame members 20*a*, 20*b*, 20*c*, 20*d*. Specifically, in this exemplary embodiment, the frame 20 includes four such frame members: a first frame member 20*a* and a second frame member 20*b*, which are of equal length and define the opposing ends of the frame 20; and a third frame member 20*c* and a fourth frame member 20*d*, which are of equal length and extend between the first frame member 20*a* and the second frame member 20*b* to define the opposing sides of the frame 20. In this exemplary embodiment, the length of the first frame member 20*a* and the second frame member 20*b* is shorter than the length of the third frame member 20*c* and the fourth frame member 20*d* so that the frame 20 retains a rectangular shape corresponding to that of the opening 50*a* defined by the ceiling structure 50 and the door 30. Of course, it should be appreciated that the number and/or dimension of the frame members 20*a*, 20*b*, 20*c*, 20*d* and shape of the door 30 may be modified to better accommodate differently shaped ceiling structure or openings without departing from the spirit or scope of the present invention.

For improved durability and moisture resistance relative to wood, the respective frame members 20*a*, 20*b*, 20*c*, 20*d* of the frame 20 are preferably constructed of a metal material. Specifically, in this exemplary embodiment, each frame member 20*a*, 20*b*, 20*c*, 20*d* is constructed of aluminum and formed using known extrusion techniques, such that each frame member 20*a*, 20*b*, 20*c*, 20*d* is integrally formed (i.e., of a unitary construction). Referring now specifically to FIGS. 3-6 and 7A, the die (or dies) from which the respective frame members 20*a*, 20*b*, 20*c*, 20*d* of the frame 20 are extruded is such that, when formed, each frame member 20*a*, 20*b*, 20*c*, 20*d* defines, and thus can be characterized as including: the recess 22 for receiving the perimeter of the door 30; the outer cavity 24 for receiving weatherstripping material 60; and an inner cavity for receiving connectors 21*a*, 21*b*, 23*a*, 23*b*, 25*a*, 25*b*, 27*a*, 27*b* configured to connect the ends of adjacently positioned frame members 20*a*, 20*b*, 20*c*, 20*d* together, as perhaps best shown by viewing FIGS. 3 and 4 in sequence. During the extrusion process, the recess 22, the outer cavity 24, and the inner cavity of each respective frame member 20*a*, 20*b*, 20*c*, 20*d* are concurrently formed. In this regard, formation of the frame members 20*a*, 20*b*, 20*c*, 20*d* via extrusion thus alleviates the need for additional manufacturing processes directed to the creation of a groove for receiving weatherstripping following initial formation or shaping of the frame members, as is common within the art.

As perhaps shown best in FIGS. 5, 6, and 7A, in this exemplary embodiment, the inner cavity of each frame member 20*a*, 20*b*, 20*c*, 20*d* is actually comprised of two cavities: a first inner cavity 26*a*; and a second inner cavity 26*b* that is located below the first inner cavity 26*a*. Both the first inner cavity 26*a* and the second inner cavity 26*b* of each frame member 20*a*, 20*b*, 20*c*, 20*d* span the length of the frame member 20*a*, 20*b*, 20*c*, 20*d* so that the interior of each frame member 20*a*, 20*b*, 20*c*, 20*d* is substantially hollow. Such hollow construction not only reduces the overall weight of the frame 20, thus making mounting of the frame 20 to the ceiling structure 50 and overall installation of the assembly 10 easier, but also enables the respective ends of each frame member 20*a*, 20*b*, 20*c*, 20*d* to receive one or, as is the case in this exemplary embodiment, multiple connectors of the plurality of connectors 21*a*, 21*b*, 23*a*, 23*b*, 25*a*, 25*b*, 27*a*, 27*b*. In this exemplary embodiment, and referring now to FIGS. 3 and 7A, adjacently positioned ends of the frame members 20*a*, 20*b*, 20*c*, 20*d* share and are connected together by a pair of connectors including: one connector 21*a*, 23*a*, 25*a*, 27*a* that is received within the first inner cavity 26*a* of each end; and another connector 21*b*, 23*b*, 25*b*, 27*b* that is received within the second inner cavity 26*b* of each end, as described in greater detail below.

Figure 7A:
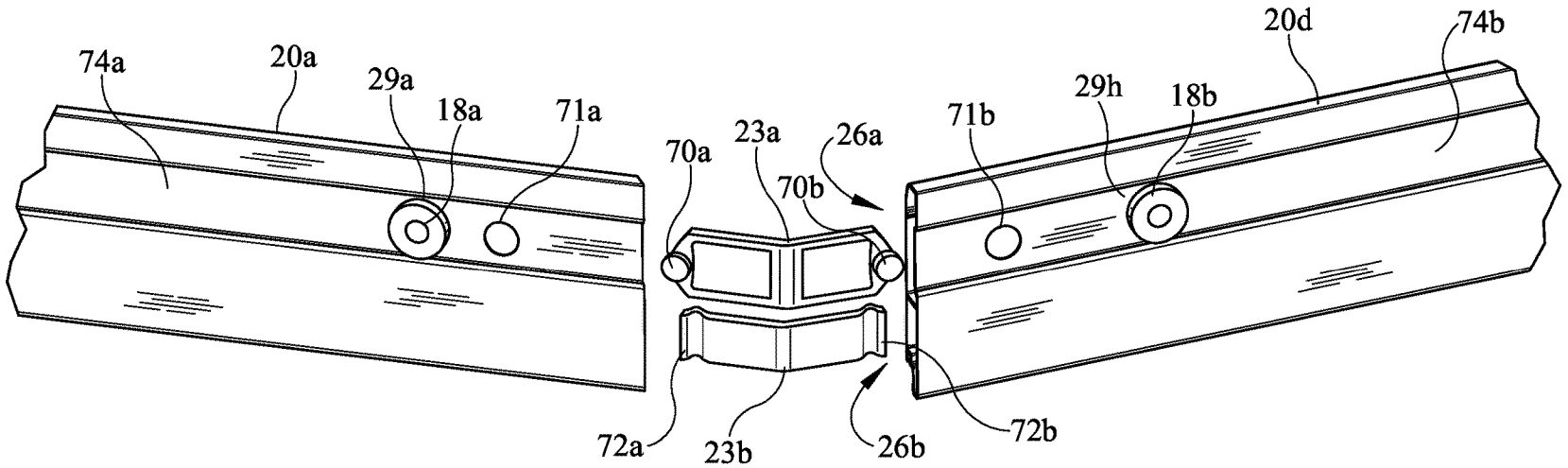
FIG. 7A is a partial view of the frame of the exemplary door and retractable ladder assembly of FIG. 1, showing two frame members of the frame disconnected from each other.
Figure 7B:
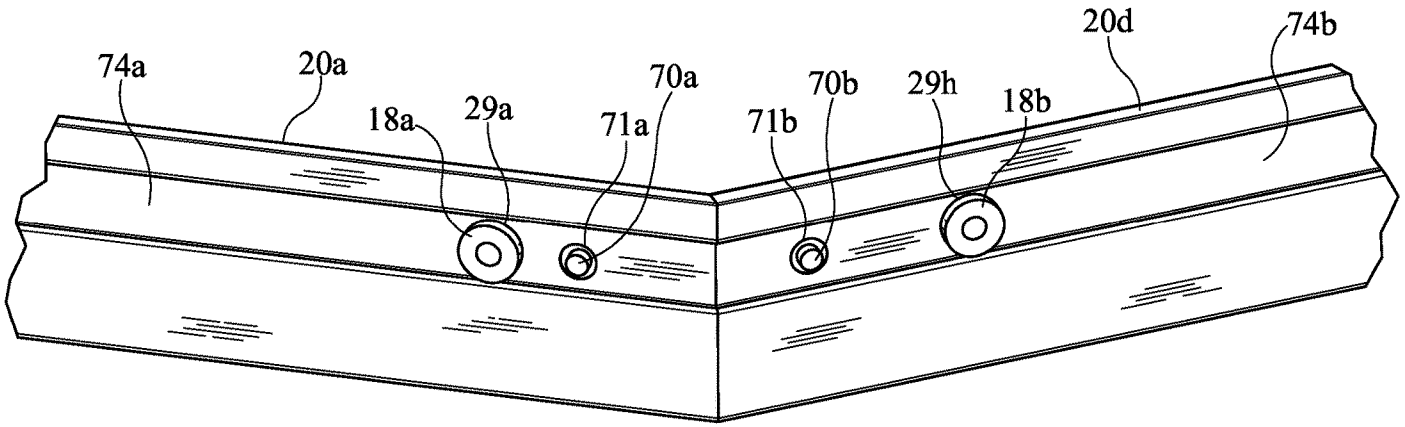
FIG. 7B is a partial view similar to FIG. 7A, but with the two frame members connected together.

Referring now to FIGS. 7A and 7B, in this exemplary embodiment, the adjacently positioned ends of the first frame member 20*a* and the fourth frame member 20*d* are connected together by: a first (or upper) connector 23*a*, which is received in the first cavity 26*a* of both the first frame member 20*a* and the fourth frame member 20*d*; and a second (or lower) connector 23*b*, which is received in the second cavity 26*b* of both the first frame member 20*a* and the fourth frame member 20*d*. In this exemplary embodiment, the upper connector 23*a* is a spring-loaded connector that includes a first male member 70*a* and a second male member 70*b*, which, in this case, are buttons, that are biased toward an extended position. In use, the biasing force biasing the first male member 70*a* is overcome as the upper connector 23*a* is inserted into the first cavity 26*a* of the first frame member 20*a* until reaching a pocket hole 71*a* defined by the first frame member 20*a*, at which time the first male member 70*a* is returned to the extended position and extends through the pocket hole 71*a* and interlocks the upper connector 23*a* with the first fame member 20*a*. Similarly, the biasing force biasing the second male member 70*b* is overcome as the upper connector 23*a* is inserted into the first cavity 26*a* of the fourth frame member 20*d* until reaching a pocket hole 71*b* defined by the fourth frame member 20*d*, at which time the second male member 70*b* is returned to the extended position and extends through the pocket hole 71*b* and interlocks the upper connector 23*a* with the fourth frame member 20*d*. Once the first male member 70*a* and the second male member 70*b* are in an extended position through the pocket hole 71*a*, 71*b* defined by the first frame member 20*a* and the fourth frame member 20*d*, respectively, the first frame member 20*a* and the fourth frame member

20*d* cannot be pulled away from one another without first manipulating at least one of the male members 70*a*, 70*b* of the upper connector 23*a*.

Referring still to FIGS. 7A and 7B, the lower connector 23*b* includes a first flange 72*a* and a second flange 72*b* that are biased toward a non-compressed configuration. In use, the biasing force biasing the first flange 72*a* toward a non-compressed configuration is overcome as the lower connector 23*b* is inserted into the second cavity 27*b* of the first frame member 20*a*, thereby placing the first flange 72*a* in a compressed configuration. Similarly, the biasing force biasing the second flange 72*b* toward a non-compressed configuration is overcome as the lower connector 23*b* is inserted into the second cavity 27*b* of the fourth frame member 20*d*, thereby placing the second flange 72*b* in a compressed configuration. To urge and maintain the first flange 72*a* and the second flange 72*b* in the compressed configuration, the second cavity 26*b* of the first frame member 20*a* and the fourth frame member 20*d* include a narrowed portion 15 (FIGS. 5 and 6), which has a width that is smaller than the first flange 72*a* or the second flange 72*b* when in the non-compressed configuration, and which is defined by an outer side wall 16 and bottom wall 19 of each respective frame member 20*a*, 20*d*. Once inserted within the first cavity 26*b* of the first frame member 20*a* and the second frame member 20*d*, the biasing force urging the first flange 72*a* and the second flange 72*b* toward the non-compressed configuration and against the outer side wall 16 and bottom wall 19 helps to prevent the lower connector 23*b* from being easily dislodged. In this regard, the lower connector 23*b* further helps to prevent the first frame member 20*a* and the fourth frame member 20*d* from inadvertently being pulled apart and twisted in an undesired manner.

The upper connectors 21*a*, 25*a*, 27*a* used to connect the first frame member 20*a* to the third frame member 20*c*, the second frame member 20*b* to the fourth frame member 20*d*, and second frame member 20*b* to the third frame member 20*c* are of identical construction and provide the same functionality as the upper connector 23*a* described above used to connect the first frame member 20*a* to the fourth frame member 20*d*. Furthermore, the ends of the frame members 20*a*, 20*b*, 20*c*, 20*d* also define pocket holes to accommodate the male members of such connectors. Similarly, the lower connectors 21*b*, 25*b*, and 27*b* used to connected the first frame member 20*a* to the fourth frame member 20*d* are of identical construction and provide the same functionality as the lower connector 23*b* described above used to connect the first frame member 20*a* to the fourth frame member 20*d*. As such, the outer side wall 16 and the bottom wall 19 of each frame member 20*a*, 20*b*, 20*c*, 20*d*, also define a narrowed portion 15 to urge and maintain the flanges of such connectors in a compressed configuration when the frame 20 is assembled.

To enable the frame 20 to be mounted flush against the ceiling structure 50 and to prevent inadvertent manipulation of the first male member 70*a* and the second male member 70*b* of each upper connector 21*a*, 23*a*, 25*a*, 27*a*, in this exemplary embodiment, the outer side wall 16 of each frame member 20*a*, 20*b*, 20*c*, 20*d* defines a recessed side portion 74*a*, 74*b*, though only the recessed side portion 74*a*, 74*b* of the first frame member 20*a* and the fourth frame member 20*d* are visible. When the frame 20 is assembled, the recessed side portion 74*a*, 74*b* of each frame member 20*a*, 20*b*, 20*c*, 20*d* collectively defines a side recess 74 in which the first male member 70*a* and the second male member 70*b* of each upper connector 21*a*, 23*a*, 25*a*, 27*a* is contained. The side recess 74 also serves to accommodate bushings 18*a*, 18*b* (FIGS. 7A and 7B) for the fasteners used to mount the frame 20 to the ceiling structure 50.

Referring now to FIGS. 1-4, 7A, and 7B, when the frame 20 is assembled (i.e., when the frame members 20*a*, 20*b*, 20*c*, 20*d* are connected by the plurality of connectors 21*a*, 21*b*, 23*a*, 23*b*, 25*a*, 25*b*, 27*a*, 27*b*), each connector 21*a*, 21*b*, 23*a*, 23*b*, 25*a*, 25*b*, 27*a*, 27*b* is housed within the two frame members 20*a*, 20*b*, 20*c*, 20*d* in which it is inserted. In this regard, the connectors 21*a*, 21*b*, 23*a*, 23*b*, 25*a*, 25*b*, 27*a*, 27*b* maintaining the frame members 20*a*, 20*b*, 20*c*, 20*d* in association with each other are not visible from an exterior of the frame 20, except for the male members 70*a*, 70*b* of the upper connectors 21*a*, 23*a*, 25*a*, 27*a*.

Referring now to FIGS. 3, 4, 7A, and 7B, in this exemplary embodiment, after the frame members 20*a*, 20*b*, 20*c*, 20*d* are formed, the ends of each respective frame member 20*a*, 20*b*, 20*c*, 20*d* are cut at a predetermined angle. More specifically, each respective end of each respective frame member 20*a*, 20*b*, 20*c*, 20*d* is cut at a predetermined angle that corresponds to another predetermined angle at which an end of another, adjacent frame member 20*a*, 20*b*, 20*c*, 20*d* is cut, such that, when connected, the two ends form a miter joint. When assembled, the frame 20 thus defines, and can be characterized as including, a plurality of miter joints 28*a*, 28*b*, 28*c*, 28*d* through which the connectors 21*a*, 21*b*, 23*a*, 23*b*, 25*a*, 25*b*, 27*a*, 27*b* extend, as perhaps best shown in FIGS. 7A and 7B. The angles at which the ends of the frame members 20*a*, 20*b*, 20*c*, 20*d* are cut are preferably based on the angles exhibited by the corners defined by the ceiling structure 50, which, in this case, are four 90° angles, so that the miter joints 28*a*, 28*b*, 28*c*, 28*d* of the frame 20 closely correspond to the corners of the ceiling structure 50. Accordingly, in this exemplary embodiment, the respective ends of each frame member 20*a*, 20*b*, 20*c*, 20*d* are cut at a 45° angle so that each miter joint of the frame defines a 90° angle. Cutting the ends of the frame members 20*a*, 20*b*, 20*c*, 20*d* in the foregoing manner not only helps to ensure a snug fit within the opening 50*a* defined by the ceiling structure 50, thereby minimizing the presence of gaps between the frame 20 and ceiling structure 50, but also prevents bending of the frame 20 when mounted to the ceiling structure 50.

Although the corners defined by the ceiling structure 50 are primarily discussed herein and illustrated within the drawings as forming 90° angles, implementations are, however, contemplated in which the ceiling structure 50 defines corners of other angles. As such, alternative embodiments, are contemplated in which the ends of the frame members 20*a*, 20*b*, 20*c*, 20*d* are cut so that the frame 20 includes one or more miter joints that are less than or greater than 90°.

Referring now to FIGS. 2, 3, and 5, the recess 22 of the frame 20 is coextensive with, and is configured to receive, the perimeter of the door 30 when the assembly 10 is in the closed configuration. To this end, the die (or dies) from which the respective frame members 20*a*, 20*b*, 20*c*, 20*d* of the frame 20 are extruded is such that, when each frame member 20*a*, 20*b*, 20*c*, 20*d* is formed, a bottom wall 19 of the frame member 20*a*, 20*b*, 20*c*, 20*d* defines a recessed portion 22*a*, 22*b*, 22*c*, 22*d*, which is coextensive with the length, l, of the inner side of the frame member 20*a*, 20*b*, 20*c*, 20*d*, and in which an outer edge of the door 30 can be received, as shown best in FIGS. 3 and 5. As shown in FIG. 5, in this exemplary embodiment, the bottom wall 19 of each frame member 20*a*, 20*b*, 20*c*, 20*d* defines, and thus can be characterized as including: a first lateral portion 19*a* that defines the lowermost surface of each frame member 20*a*, 20*b*, 20*c*, 20*d*; a second lateral portion 19*c* that is located above the first lateral portion 19*a*; a third lateral portion 19*e* that is located above the second lateral portion 19*c*; a first vertical portion 19*b*, which interconnects the first lateral portion 19*a* and the second lateral portion 19*c*; and a second vertical portion 19*d*, which interconnects the second lateral portion 19*c* and the third lateral portion 19*e*. The recessed portion 22*a*, 22*b*, 22*c*, 22*d* of each frame member 20*a*, 20*b*, 20*c*, 20*d*, in this exemplary embodiment, is collectively defined by the first lateral portion 19*a*, the second lateral portion 19*c*, and the first vertical portion 19*b* of the bottom wall 19 of the frame member 20*a*, 20*b*, 20*c*, 20*d*.

Referring still to FIGS. 2, 3, and 5, when the frame 20 is assembled, the recessed portions 22*a*, 22*b*, 22*c*, 22*d* of the respective frame members 20*a*, 20*b*, 20*c*, 20*d* meet together and collectively define the recess 22, which is continuous along the bottom of the frame 20. As a result of the recess 22 being continuous along the bottom of the frame 20, the inner surface 30*a* of the door 30 is thus able to rest flush against the second lateral portion 19*c* of the bottom wall 19 of each respective frame member 20*a*, 20*b*, 20*c*, 20*d* (FIG. 5) or, if present, weatherstripping material 60 inserted within the outer cavity 24 (FIG. 6). In this way, the recess 22 thus helps to prevent warping of the door 30 and the presence of gaps or cracks through which light or other environmental conditions can escape through the central opening 20' of the frame 20.

To further limit the extent to which light or other environmental conditions can escape from the upper story of the building, the dimensions of the recess 22 are such that the door 30 is snug (i.e., closely fitted) within the recess 22 when closed. To this end, the width, $w_R$, of the recessed portion 22*a*, 22*b*, 22*c*, 22*d* of each frame member 20*a*, 20*b*, 20*c*, 20*d* is preferably such that only enough spacing is provided between the outer edge of the frame 20 received therein and the first vertical portion 19*b* of the bottom wall 19 as to enable the door 30 to transition between the closed position and the open position, as shown best in FIG. 5. Further, the height, $h_R$, of the recessed portion 22*a*, 22*b*, 22*c* 22*d*, and thus the recess 22 as a whole, is preferably equal to or greater than the height, hp, of the door 30 so that the outer surface 30*b* of the door 30 is not positioned below the lowermost portion (i.e., the first lateral portion 19*a*) of the bottom wall 19 of each frame member 20*a*, 20*b*, 20*c*, 20*d* when the door 30 is in the closed position. In other words, the height, $h_R$, of the recess 22 is sufficient as to enable the door 30 to be fully received within the frame 20 when the assembly 10 is in the closed configuration. More specifically, in this exemplary embodiment, the height, $h_R$, of the recess 22 is greater than the height, hp, of the door 30 so that weatherstripping material 60 can be provided within the frame 20 while still permitting the door 30 to be fully received within the frame 20 when the assembly 10 is in the closed configuration. In some embodiments, the height, $h_R$, of the recess 22 and weatherstripping material 60 inserted within the outer cavity 24 may be such that the outer surface 30*b* of the door 30 and the lowermost portion of the bottom wall 19 of each frame member 20*a*, 20*b*, 20*c*, 20*d* resides along substantially the same plane.

Referring now to FIGS. 3, 5, and 6, as noted above, in this exemplary embodiment the frame 20 also defines the outer cavity 24 in which weatherstripping material 60 can be inserted. As with the recess 22, the outer cavity 24 is also collectively defined by the respective frame members 20*a*, 20*b*, 20*c*, 20*d* of the frame 20. In this regard, the die (or dies) from which the frame members 20*a*, 20*b*, 20*c*, 20*d* are extruded is such that, when each frame member 20*a*, 20*b*, 20*c*, 20*d* is formed, the bottom wall 19 of the frame member 20*a*, 20*b*, 20*c*, 20*d* defines, at least partially, an outer cavity portion 24*a*, 24*b*, 24*c*, 24*d*, which is coextensive in length with the recessed portion 22*a*, 22*b*, 22*c*, 22*d* of the frame member 20*a*, 20*b*, 20*c*, 20*d*. When the frame 20 is assembled, the outer cavity portions 24*a*, 24*b*, 24*c*, 24*d* of the respective frame members 20*a*, 20*b*, 20*c*, 20*d* meet and collectively define the outer cavity 24, which, like the recess 22, is continuous along the bottom of the frame 20.

Referring still to FIGS. 3, 5, and 6, in this exemplary embodiment, the outer cavity portion 24*a*, 24*b*, 24*c*, 24*d* of each respective frame member 20*a*, 20*b*, 20*c*, 20*d* is primarily defined by the second lateral portion 19*c*, third lateral portion 19*e*, and second vertical portion 19*d* of the bottom wall 19 of the frame member 20*a*, 20*b*, 20*c*, 20*d*, with only a small portion of the outer cavity portion 24*a*, 24*b*, 24*c*, 24*d* being defined by an inner side wall 17 of the frame member 20*a*, 20*b*, 20*c*, 20*d*. In this exemplary embodiment, the outer cavity portion 24*a*, 24*b*, 24*c*, 24*d* is thus located above the recessed portion 22*a*, 22*b*, 22*c*, 22*d* of each frame member 20*a*, 20*b*, 20*c*, 20*d*. When inserted in the outer cavity portion 24*a*, 24*b*, 24*c*, 24*d* of each frame member 20*a*, 20*b*, 20*c*, 20*d*, the weatherstripping material 60 extends from the outer cavity 24 into the recess 22 of the frame 20. As such, when the door 30 is in the closed position, the weatherstripping material 60 is sandwiched between the frame 20 and the door 30, thus establishing a barrier that is coextensive with the perimeter of the door 30 and effectively fills in any gaps or cracks existing between the inner surface 30*a* of the door 30 and the frame 20.

Referring still to FIGS. 3, 5, and 6, to permit the weatherstripping material 60 to extend from the outer cavity portion 24*a*, 24*b*, 24*c*, 24*d* into the recessed portion 22*a*, 22*b*, 22*c*, 22*d*, the second lateral portion 19*c* of the bottom wall 19 of each frame member 20*a*, 20*b*, 20*c*, 20*d* defines a channel 19*f*. In this exemplary embodiment, the weatherstripping material 60 is bulb-type weatherstripping including a T-shaped proximal end 60*a* corresponding to the shape of the outer cavity portion 24*a*, 24*b*, 24*c*, 24*d* and channel 19*f* of the bottom wall 19 of the frame members 20*a*, 20*b*, 20*c*, 20*d* and a bulbous distal end 60*b* with a width exceeding that of the channel 19*f*. Of course, other weatherstripping materials may alternatively be utilized without departing from the spirit or scope of the present invention.

Referring now specifically to FIG. 4, to facilitate mounting of the frame 20 within the opening 50*a* defined by the ceiling structure 50, each frame member 20*a*, 20*b*, 20*c*, 20*d* is drilled at the time of manufacture as to define one or more holes 29*a*, 29*b*, 29*c*, 29*d*, 29*e*, 29*f*, 29*g*, 29*h* of suitable dimension to receive a fastener (not shown), such as a lag screw, for securing the frame member 20*a*, 20*b*, 20*c*, 20*d* to the ceiling structure 50. Specifically, in this exemplary embodiment, each frame member 20*a*, 20*b*, 20*c*, 20*d* is drilled to define two such holes proximal to the ends of the frame member 20*a*, 20*b*, 20*c*, 20*d*. As the aforementioned holes 29*a*, 29*b*, 29*c*, 29*d*, 29*e*, 29*f*, 29*g*, 29*h* are drilled within the respective frame members 20*a*, 20*b*, 20*c*, 20*d* at the time of manufacture, the end user does not have to modify the structure of the frame 20 at the time of installation, thus further easing the installation process. To balance the load carried by the fasteners used to mount the frame 20 to the ceiling structure 50, each hole 29*a*, 29*b*, 29*c*, 29*d*, 29*e*, 29*f*, 29*g*, 29*h* in each respective frame member 20*a*, 20*b*, 20*c*, 20*d* is positioned opposite of another hole 29*a*, 29*b*, 29*c*, 29*d*, 29*e*, 29*f*, 29*g*, 29*h* in another, oppositely positioned frame member 20*a*, 20*b*, 20*c*, 20*d*, as shown best in FIG. 4. In this exemplary embodiment, a bushing 18*a*, 18*b* (FIGS. 7A and 7B) is also inserted within each of the holes 29*a*, 29*b*, 29*c*, 29*d*, 29*e*, 29*f*, 29*g*, 29*h* to ensure the fasteners responsible for mounting the frame 20 to the ceiling structure 50 are properly aligned and to avoid bending of the frame 20 at the time of installation.

Figure 9:
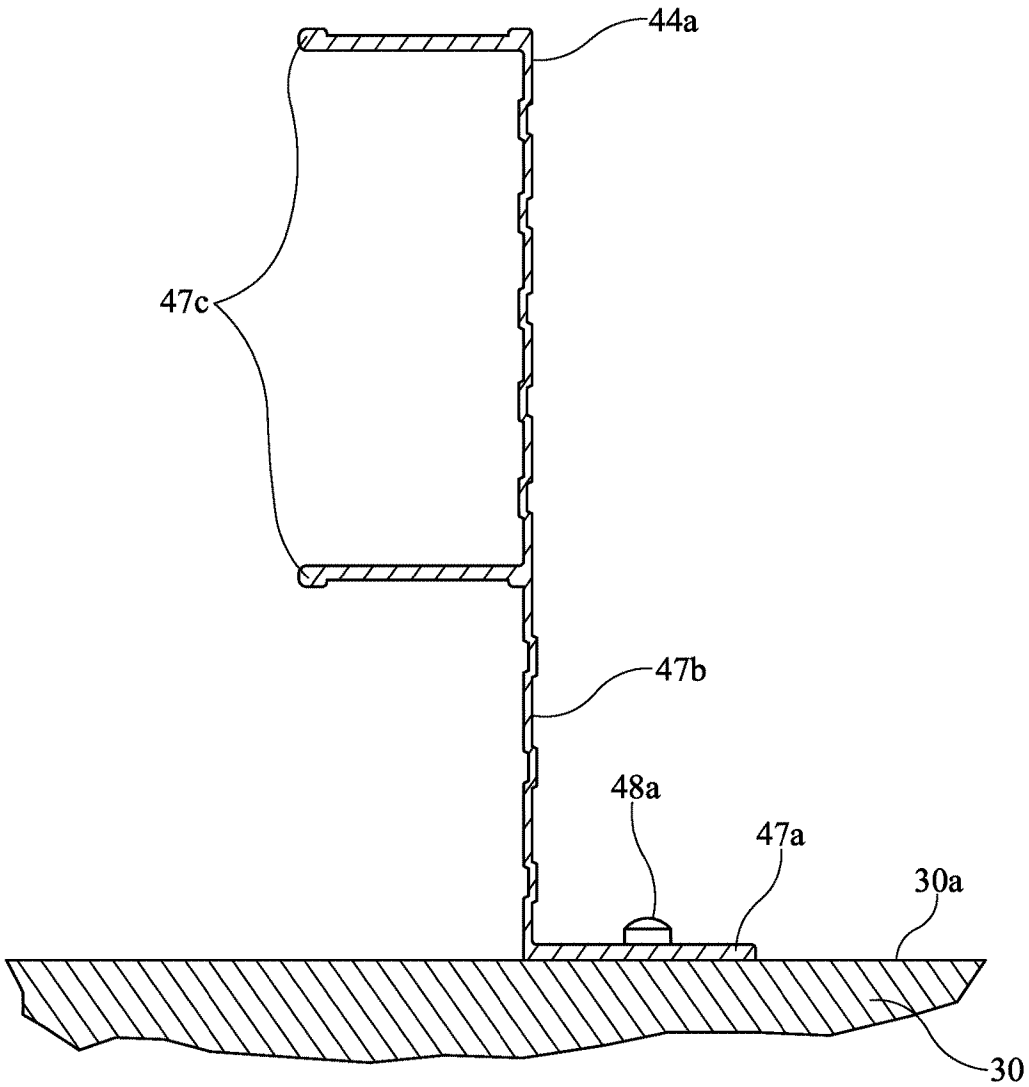
FIG. 9 is a sectional view of a ladder rail and a portion of a door of the exemplary door and ladder assembly of FIG. 1.

FIG. 9 is a sectional view of a rail of a first ladder section 40*a* and a portion of the door 30.

Referring now to FIGS. 1 and 9, in this exemplary embodiment, the retractable ladder 40 includes three ladder sections: a first ladder section 40*a*, which is mounted to the inner surface 30*a* of the door 30; a second ladder section 40*b* mounted for rotation with respect to the first ladder section 40*a* by a first pair of hinges 42*a*; and a third ladder section 40*c* mounted for rotation with respect to the second ladder section 40*b* by a second pair of hinges 42*b*. Each ladder section 40*a*, 40*b*, 40*c* includes: a first rail 44*a*, 45*a*, 46*a*; a second rail 44*b*, 45*b*, 46*b*; and one or more steps 44*c*, 45*c*, 46*c* extending between the first rail 44*a*, 45*a*, 46*a* and the second rail 44*b*, 45*b*, 46*b*. In this exemplary embodiment, the first ladder section 40*a* is directly mounted to the inner surface 30*a* of the door 30. Specifically, and referring now specifically to FIG. 9, the first rail 44*a* of the first ladder section 40*a* of the retractable ladder 40 is mounted directly to the inner surface 30*a* of the door 30 by a plurality of fasteners 48*a* (one of which is shown in FIG. 9). The first rail 44*a* of the first ladder section 40*a* defines, and thus can be characterized as including: a base 47*a*, which rests directly on, and flush with, the inner surface 30*a* of the door 30; a main body 47*b* extending upwardly from the base 47*a*; and a pair of arms 47*c* extending outwardly from the main body 47*b* and parallel with the inner surface 30*a* of the door 30 to define a cavity in which each step of the first ladder section 40*a* is received and maintained. To provide adequate spacing to accommodate a user's foot on each step of the first ladder section 40*a*, the pair of arms 47*c*, and thus cavity for receiving each step of the first ladder section 40*a*, are spaced a predetermined distance from the base 47*a* of the first rail 44*a*, and thus inner surface 30*a* of the door 30. Although not shown in the same detail as provided for the first rail 44*a* in FIG. 9, the second rail 44*b* of the first ladder section 40*a* is identical in construction and function as the first rail 44*a*. By mounting the first ladder section 40*a* directly to the inner surface 30*a* of the door 30, the assembly 10 of the present invention thus eliminates the need for intermediate connection means, such as runners and/or brackets, common in door and retractable ladder assemblies of known construction in which the retractable ladder is spaced apart from and indirectly connected to the door 30, thus further simplifying overall manufacture.

Although the frame 20 is primarily described herein in the context of being maintained in an assembled configuration by virtue of the upper connectors 21*a*, 23*a*, 25*a*, 27*a* and lower connectors 21*b*, 23*b*, 25*b*, 27*b* described above with reference to FIGS. 3 and 7A, alternative embodiments which utilize alternative connectors are also contemplated.

Figure 8:
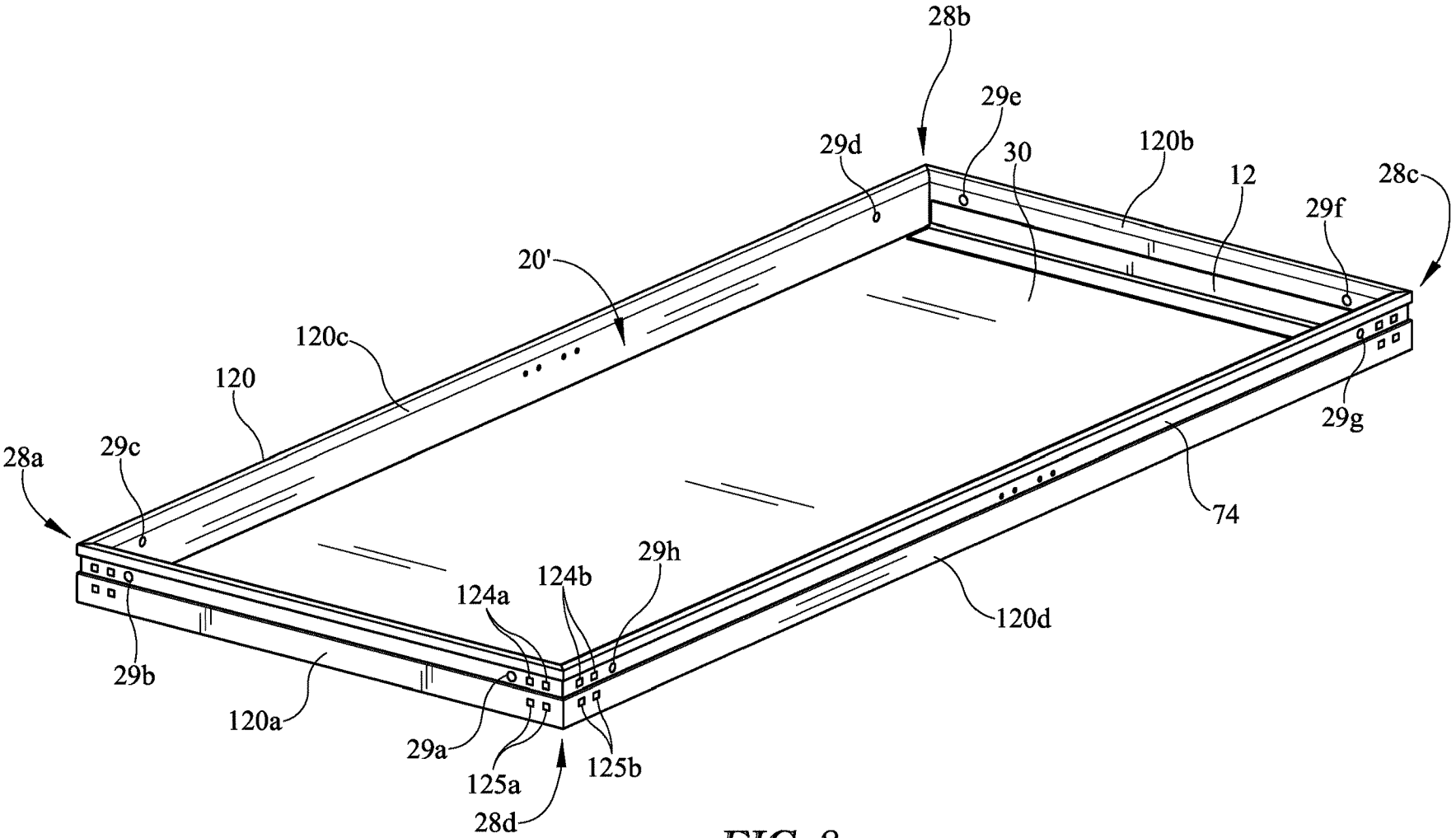
FIG. 8 is a perspective view of another frame made in accordance with the present invention.
Figure 8A:
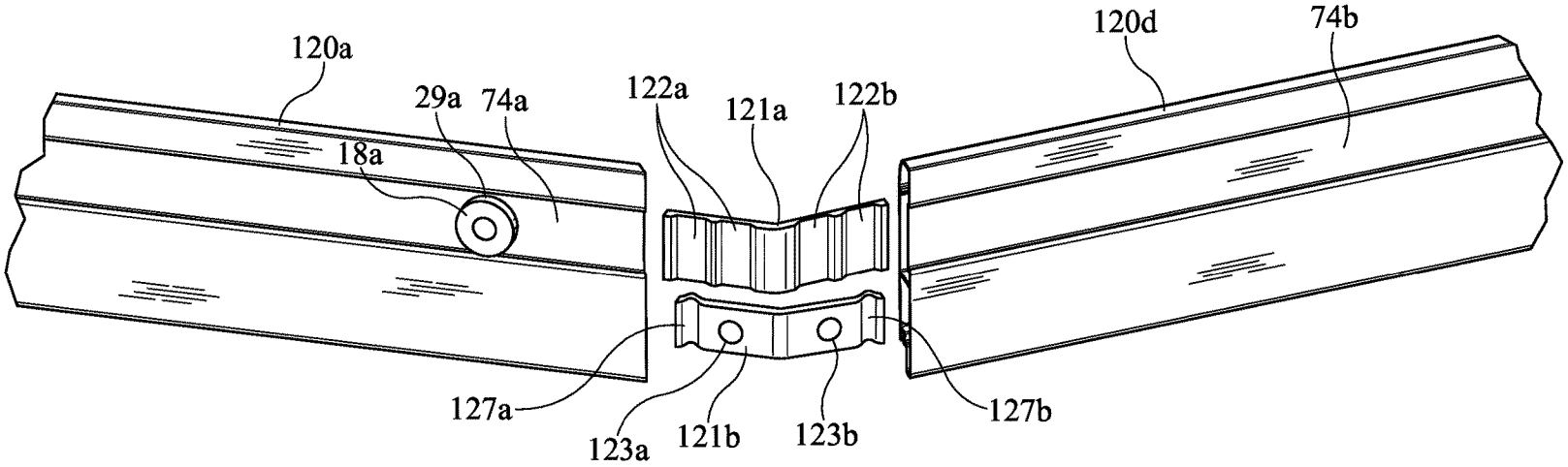
FIG. 8A is a partial view of the frame of FIG. 8, showing two frame members of the frame of FIG. 8 disconnected from each other.
Figure 8B:
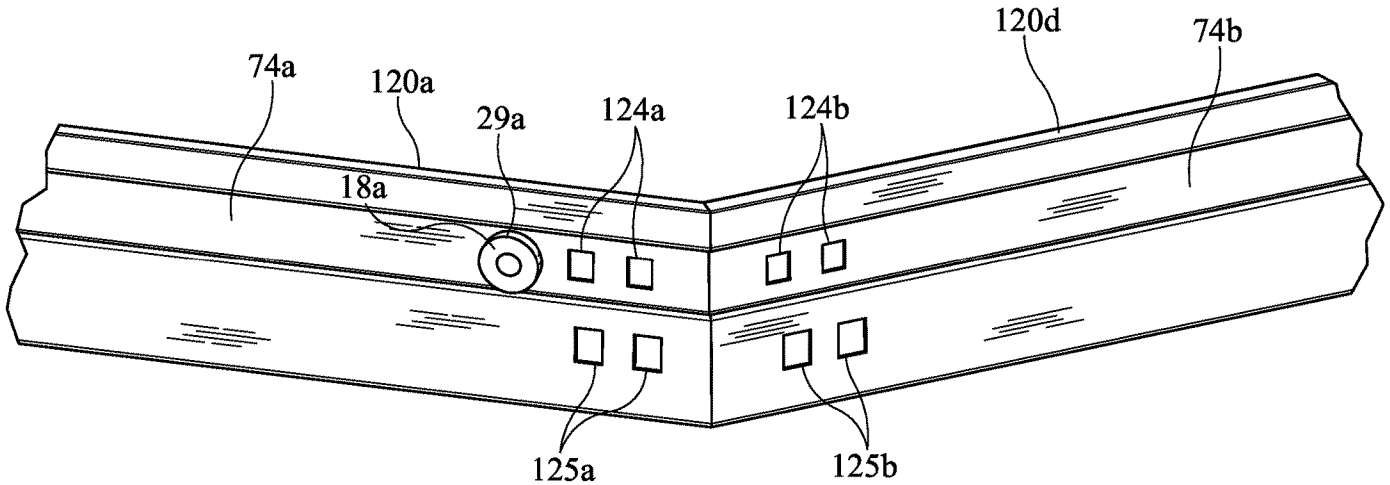
FIG. 8B is partial view similar to FIG. 8A, but with the two frame members connected together.

FIGS. 8 and 8A and 8B are, respectively, perspective and partial views of another frame 120 made in accordance with the present invention which may be utilized in place of the frame 20 described above with reference to FIGS. 1-6, 7A, and 7B within the assembly 10.

Referring now to FIGS. 8, 8A, and 8B, in this exemplary embodiment, the frame 120 is of the same general construction and provides the same functionality as the frame 20 described above with reference to FIGS. 1-6, 7A, and 7B. In this regard, like features are provided with like reference numerals throughout the present application, and the frame 120 also includes four frame members: a first frame member 120*a*; a second frame member 120*b*; a third frame member 120*c*; and a fourth frame member 120*d* which are connected together at their ends, as shown best in FIG. 8. Unlike the frame 20 described above, however, in this exemplary embodiment, the respective frame members 120*a*, 120*b*, 120*c*, 120*d* are connected and maintained in association with each other via a connection means that does not require the ends of each frame member 120*a*, 120*b*, 120*c*, 120*d* to define a pocket hole for receiving a male member of an upper connector, as perhaps shown best in FIG. 8A. Rather, adjacently positioned frame members 120*a*, 120*d* are maintained in association with each other primarily by virtue of being crimped to a first (or upper) connector 121*a* deposited within the first cavity 126*a* of the frame members 120*a*, 120*b*, 120*c*, 120*d* and a second (or lower) connector 121*b* deposited within the second cavity 126*b* of the frame members 120*a*, 120*b*, 120*c*, 120*d*, as further described below.

Referring now specifically to FIGS. 8A and 8B, the first frame member 120*a* and the fourth frame member 120*d* are connected by an upper connector 121*a* that is configured to be inserted in the first cavity 126*a* of the first frame member 120*a* and the second frame member 120*d* and a lower connector 121*b* that is configured to be inserted in the second cavity 126*b* of the first frame member 120*a* and the second frame member 120*b*. The upper connector 121*a* defines, and thus can be characterized as including, a plurality of slots 122*a*, 122*b*, where each respective slot 122*a*, 122*b* is configured to receive a portion of the first frame member 120*a* and the fourth frame member 120*d*. Specifically, in this exemplary embodiment, the upper connector 121*a* includes a first pair of slots 122*a* that are configured to receive a portion of the first frame member 120*a* and a second pair of slots 122*b* that are configured to receive a portion of the fourth frame member 120*d*. The lower connector 121*b* is of the same general construction and provides the same functionality as the lower connectors 21*b*, 23*b*, 25*b*, 27*b* described above with reference to FIGS. 3 and 7A, except, in this exemplary embodiment, the lower connector 121*b* further defines a plurality of openings 123*a*, 123*b* configured to receive a portion of the two frame members 120*a*, 120*d* in which the lower connector 121*b* is inserted. Specifically, in this exemplary embodiment, the lower connector 121*b* includes a first opening 123*a* that is configured to receive a portion of the first frame member 120*a* and a second opening 123*b* that is configured to receive a portion of the fourth frame member 120*d*.

As perhaps shown best by viewing FIGS. 8A and 8B in sequence, once the upper connector 121*a* and the lower connector 121*b* are fully inserted in the first cavity 126*a* and the second cavity 126*b* of the first frame member 120*a* and the fourth frame member 120*d*, the adjacently positioned ends of the first frame member 120*a* and the fourth frame member 120*d* are crimped by a crimping machine, thus creating a first pair of upper indentations 124*a* that are received in the first pair of slots 122*a* and a second pair of upper indentations 124*b* that are received in the second pair of slots 122*b* of the upper connector 121*a*. The crimping machine also creates a first pair of lower indentations 125*a* and a second pair of lower indentations 125*b*. One indentation of the first pair of lower indentations 125*a* is received in a slot defined by the first flange 127*a* of the lower connector 121*b*, while the other indentation of the first pair of lower indentations 125*a* is received in the first opening 123*a* of the lower connector 121*b*. Similarly, one indentation of the second pair of lower indentations 125*b* is received in a slot defined by the second flange 127*b* of the lower connector 121*b*, while the other indentation of the second pair of lower indentations 125*b* is received in the second opening 123*b* of the lower connector 121*b*. The remaining ends of adjacently positioned frame members 120*a*, 120*b*, 120*c*, 120*d* are joined in the same manner and using the same types of upper and lower connectors as described above for the first frame member 120*a* and the fourth frame member 120*d*. The above-described crimping process thus enables the respective frame members 120*a*, 120*b*, 120*c*, 120*d* to be permanently connected together in a manner which prevents the frame 120 from being pulled apart or twisted in an undesired manner.

One of ordinary skill in the art will recognize that additional embodiments and implementations are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A door and retractable ladder assembly, comprising:

a frame configured to be mounted within an opening defined by a ceiling structure of a building, the frame defining a central opening for providing passage through the frame, and the frame including a plurality of metal frame members formed by extrusion;

a door mounted to the frame, the door configured to transition between a closed position to cover the central opening defined by the frame and an open position to uncover the central opening defined by the frame; and a retractable ladder including a plurality of ladder sections, the plurality of ladder sections including a first ladder section directly mounted to an inner surface of the door, and the first ladder section including a first rail and a second rail, the first rail and the second rail each being integrally formed and each including: (i) a base mounted to the inner surface of the door and continuously extending along an entire length of each of the first rail and the second rail; (ii) a main body extending upwardly from the base and continuously extending along an entire length of each of the first rail and the second rail; and (iii) a pair of arms, the pair of arms extending outwardly from the main body and in parallel with the inner surface of the door to define a cavity that is spaced a predetermined distance from the base and in which one or more steps are received, and the one or more steps extending between the first rail and the second rail.

2. The door and retractable ladder assembly according to claim 1, wherein a bottom wall of the frame defines at least one of: (i) a recess that is coextensive with and is configured to receive a perimeter of the door when the door is in the closed position; and (ii) an outer cavity configured to receive a weatherstripping material.

3. The door and retractable ladder assembly according to claim 2, wherein the bottom wall defines both the recess and the outer cavity.

4. The door and retractable ladder assembly according to claim 1, wherein each metal frame member includes an end defining an inner cavity for receiving one or more connectors for connecting the plurality of frame members together.

5. The door and retractable ladder assembly according to claim 4, wherein the end of each metal frame member is cut at a predetermined angle corresponding to another predetermined angle cut in the end of another metal frame member, such that, when assembled, the frame includes a plurality of miter joints.

6. The door and retractable ladder assembly according to claim 5, wherein each miter joint of the plurality of miter joints defines an approximately 90° angle.

7. The door and retractable ladder assembly according to claim 5, wherein each connector of the one or more connectors is housed within the inner cavity of two adjacently positioned metal frame members such that each connector extends through one miter joint of the plurality of miter joints.

8. The door and retractable ladder assembly according to claim 5, wherein the one or more connectors comprises a spring-loaded connector, the spring-loaded connector configured to interlock with two adjacently positioned metal frame members of the plurality of metal frame members.

9. The door and retractable ladder assembly according to claim 5, wherein each connector of the one or more connectors is received within a portion of two adjacently positioned metal frame members of the plurality of metal frame members, and wherein each end of each metal frame member of the plurality of metal frame members is crimped.

10. The door and retractable ladder assembly according to claim 4, wherein each metal frame member of the plurality of metal frame members defines one or more openings for receiving a fastener to mount the metal frame member to the ceiling structure of the building, and wherein the one or more openings defined by each metal frame member of the plurality of metal frame members is positioned opposite of the one or more openings defined by another metal frame member of the plurality of metal frame members.

11. The door and retractable ladder assembly according to claim 1, wherein a bottom wall of the frame defines at least one of: (i) a recess that is coextensive with and is configured to receive a perimeter of the door when the door is in the closed position; and (ii) an outer cavity configured to receive a weatherstripping material.

* * * * *